US012158011B2

(12) United States Patent
Boucké

(10) Patent No.: US 12,158,011 B2
(45) **Date of Patent: *Dec. 3, 2024**

(54) PANEL

(71) Applicant: I4F Licensing NV, Turnhout (BE)

(72) Inventor: Eddy Alberic Boucké, Menen (BE)

(73) Assignee: i4F Licensing NV, Turnhout (BE)

( * ) Notice: Subject to any disclaimer, the term of this patent is extended or adjusted under 35 U.S.C. 154(b) by 176 days.

This patent is subject to a terminal disclaimer.

(21) Appl. No.: 17/843,538

(22) Filed: Jun. 17, 2022

(65) Prior Publication Data

US 2023/0142257 A1 May 11, 2023

Related U.S. Application Data

(63) Continuation of application No. 16/960,602, filed as application No. PCT/EP2019/050459 on Jan. 9, 2019, now Pat. No. 11,377,856.

(30) Foreign Application Priority Data

Jan. 9, 2018 (NL) ..... 2020256

(51) Int. Cl.
*E04F 15/00* (2006.01)
*E04F 13/08* (2006.01)
*E04F 15/02* (2006.01)

(52) U.S. Cl.
CPC .... *E04F 15/02038* (2013.01); *E04F 13/0894* (2013.01); *E04F 2201/0146* (2013.01);
(Continued)

(58) Field of Classification Search
CPC ..... E04F 15/02033; E04F 15/02038; E04F 15/107; E04F 15/102; E04F 13/0866;
(Continued)

(56) References Cited

U.S. PATENT DOCUMENTS 7,484,337 B2 ‡ 2/2009 Hecht ..... E04F 15/02 52/578
7,896,571 B1 ‡ 3/2011 Hannig ..... B27F 1/04 403/339

(Continued)

FOREIGN PATENT DOCUMENTS

JP 2014513757 A 6/2014
WO 2010143962 A2 12/2010

(Continued)

*Primary Examiner* — Chi Q Nguyen
(74) *Attorney, Agent, or Firm* — The Webb Law Firm

(57) ABSTRACT

A panel that includes a centrally located core provided with an upper side and a lower side, which core defines a plane, at least one first coupling part and at least one second coupling part connected respectively to opposite edges of the core. The at least one first coupling part includes an upward tongue, at least one upward flank lying at a distance from the upward tongue and an upward groove formed in between the upward tongue and the upward flank wherein the upward groove is adapted to receive at least a part of a downward tongue of a second coupling part of an adjacent panel. The at least one second coupling part includes a downward tongue, at least one downward flank lying at a distance from the downward tongue, and a downward groove formed in between the downward tongue and the downward flank.

31 Claims, 12 Drawing Sheets

(52) U.S. Cl.
CPC . *E04F 2201/0161* (2013.01); *E04F 2201/042* (2013.01); *E04F 2201/043* (2013.01)

(58) Field of Classification Search
CPC ..... E04F 13/0894; E04F 15/105; E04F 2201/042; E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138; B32B 3/06; B32B 5/02; B32B 27/08; B32B 27/12; B32B 27/20; B32B 27/304; B32B 2255/10; B32B 2307/412; B32B 2307/554; B32B 2307/558; B32B 2307/72; B32B 2419/00; B32B 2451/00; B32B 2471/00
See application file for complete search history.

(56) References Cited

U.S. PATENT DOCUMENTS 8,806,832 B2 ‡ 8/2014 Kell ..... E04G 23/0285 52/588.1
10,844,610 B2 ‡ 11/2020 Boucké ..... E04F 15/02038
11,002,021 B2 ‡ 5/2021 Cappelle ..... E04F 15/02038
11,352,799 B2 * 6/2022 Boucké ..... B32B 27/08
11,377,856 B2 * 7/2022 Boucké ..... E04F 15/105
11,624,193 B2 * 4/2023 Boucké ..... E04F 15/02038 52/309.17
11,639,605 B2 * 5/2023 Boucké ..... E04F 13/18 52/588.1
11,702,848 B2 * 7/2023 Boucké ..... E04F 15/102 52/588.1
11,773,602 B2 * 10/2023 Boucké ..... B32B 15/046 52/177
11,788,302 B2 * 10/2023 Nilsson ..... B32B 9/04 52/588.1
2005/0028474 A1 * 2/2005 Kim ..... E04F 15/04 52/578
2008/0241440 A1 10/2008 Bauer
2009/0320402 A1 ‡ 12/2009 Schacht ..... E04F 15/04 52/588.1
2013/0309441 A1 ‡ 11/2013 Hannig ..... F16B 5/0056 428/100
2014/0033633 A1 ‡ 2/2014 Kell ..... E04F 15/02011 52/588.1
2015/0337540 A1 ‡ 11/2015 Cappelle ..... B32B 3/06 52/309.1
2017/0284105 A1 10/2017 Ceysson et al.
2017/0328072 A1 ‡ 11/2017 Hannig ..... E04F 15/04
2019/0017278 A1 ‡ 1/2019 De Rick ..... E04F 15/105
2020/0063443 A1 ‡ 2/2020 Boucké ..... B32B 27/08
2020/0131784 A1 ‡ 4/2020 Boucké ..... E04F 15/105
2021/0002907 A1 * 1/2021 Boucké ..... E04F 15/102
2023/0142257 A1 * 5/2023 Boucké ..... E04F 13/0894 52/588.1
2023/0183988 A1 * 6/2023 Boucké ..... E04F 15/105 52/588.1
2023/0220679 A1 * 7/2023 Boucké ..... C08L 27/06 52/588.1
2023/0304299 A1 * 9/2023 Boucké ..... E04F 15/10

FOREIGN PATENT DOCUMENTS

WO 2012126046 A1 9/2012
WO 2016029255 A1 3/2016

* cited by examiner
‡ imported from a related application

PANEL

CROSS-REFERENCE TO RELATED APPLICATIONS

This application is a continuation of U.S. patent application Ser. No. 16/960,602, filed Jan. 9, 2019, now U.S. Pat. No. 11,377,856, which is the United States national phase of International Application No. PCT/EP2019/050459 filed Jan. 9, 2019, and claims priority to The Netherlands Patent Application No. 2020256 filed Jan. 9, 2018, the disclosures of which are hereby incorporated by reference in their entirety.

BACKGROUND OF THE INVENTION

Field of the Invention

The invention relates to a panel, in particular a floor panel. The invention also relates to a covering, in particular a floor covering, comprising a plurality of interconnected panels according to the invention.

Description of Related Art

Interconnectable panels, such as interconnectable floor panels, are generally joined mechanically at edges of the panels by using complementary coupling profiles at opposite edges. Traditionally, rectangular floor panels are connected at the long edges by means of a traditional angling method. On the short side, the different coupling mechanisms can be applied, wherein a short edge coupling mechanism may, for example, be based upon vertical folding, also referred to as a drop down, wherein a downward tongue located at a short edge of a panel to be coupled is moved in downward direction, such that said downward tongue is inserted into an upward groove located at a short edge of a panel already installed. An example of such a panel is disclosed in U.S. Pat. No. 7,896,571, wherein a short edge coupling mechanism is shown being configured to vertically lock mutually coupled short edges of adjacent panels. Although this aimed vertical locking effect at the short edges is intended to stabilize the coupling between floor panels at the short edges, in practice often breakages, due to coupling edges being put under tension both during assembly and during practical use, occur at the coupling edges, which affects the reliability and durability of this type of drop down coupling.

An objection of the invention is to provide an improved panel which can be coupled in improved manner to an adjacent panel as well as to improve the coupling of the coupled panels.

SUMMARY OF THE INVENTION

The present invention thereto provides a panel, in particular a floor panel, comprising a, preferably centrally located, core provided with an upper side and a lower side, which core defines a plane; at least one first coupling part and at least one second coupling part connected respectively to opposite edges of the core, which first coupling part comprises an upward tongue, at least one upward flank lying at a distance from the upward tongue and an upward groove formed in between the upward tongue and the upward flank wherein the upward groove is adapted to receive at least a part of a downward tongue of a second coupling part of an adjacent panel, which second coupling part comprises a downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel, wherein at least a part of a side of the upward tongue facing away from the upward flank is provided with at least one first locking element, for instance in the form of an outward bulge and/or a recess, adapted for co-action with a second locking element, for instance in the form of a recess or an outward bulge, of an adjacent floor panel; wherein at least a part of a side of the downward flank is provided with at least one second locking element, for instance in the form of a recess and/or an outward bulge, adapted for co-action with the first locking element, for instance in the form of an outward bulge or a recess, of an adjacent floor panel; wherein at least a part of a side of the downward tongue facing away from the downward flank is provided with at least one third locking element, for instance in the form of an outward bulge and/or a recess, adapted for co-action with a fourth locking element, for instance in the form of a recess or an outward bulge, of an adjacent floor panel; and wherein at least a part of the upward flank is provided with at least one fourth locking element, for instance in the form of a recess and/or an outward bulge, adapted for co-action with the third locking element, for instance in the form of an outward bulge or a recess, of an adjacent floor panel.

The panel is provided with hook-like coupling means wherein the upward tongue and the downward groove, as well as the upward groove and the downward tongue, cooperate and hook behind each other. In this way, these elements provide a (horizontal) locking of two coupled panels in horizontal direction, at least when placed on a horizontal floor. The locking elements, the first, second, third and fourth, provide a vertical locking of two coupled panels in vertical direction, at least when placed on a horizontal floor. In this regard, the horizontal direction may be considered to be the direction in the plane of the panel, whereas the vertical direction may be considered to be a direction perpendicular to the horizontal direction.

The locking in vertical direction may be achieved by the co-action of the first and second locking element, as well as by the co-action of the third and fourth locking element. In an embodiment, the first and third locking elements are embodied as outward bulges, and the second and fourth locking elements are embodied as (inward) recesses. In a coupled condition, the bulges cooperate with the corresponding recesses and fit into each other. The surfaces of the bulges and recesses which are in contact with each other in coupled condition may have at least a horizontal component, thus providing a vertical locking. It may well be that the first and third locking elements are embodied as (inward) recesses, and the second and fourth locking elements are embodied as outward bulges. Other combinations/alterations are also possible, wherein for instance the first and fourth locking elements are embodied as outward bulges, or the second and third.

By providing the first and second locking elements on one side of the coupling parts (for instance the side of the downward flank), and the third and fourth locking elements on another side of the coupling parts (for instance the side of the upward flank), the vertical locking elements are distributed over the area of the coupling parts. This distribution may result in a horizontal and vertical separation of locking elements. Such separation is beneficial since, for instance upon coupling by a vertical motion, the locking elements which co-act together to provide locking, are coupled in turn, one after the other. This may reduce deformation and material stresses in these locking elements. Additionally the reduction in these forces increases the strength of the locking elements. Also, the invention allows that panels may be coupled using an angling motion, as well as that coupled panels can be uncoupled in an angling motion.

It is also possible to provide either the first and second locking elements, or the third and second locking elements, in the panel, thus effectively leaving out one of the pairs of locking elements.

At least a part of a side of the upward tongue facing toward the upward flank may be inclined with respect to a vertical direction and may be angled towards the upward flank; and at least a part of a side of the downward tongue facing toward the downward flank may be inclined with respect to a vertical direction. The part of the side of the downward tongue being inclined with respect to the vertical direction may be angled towards the downward flank. This angling and inclination creates a so-called "closed groove" system, in which the inclined parts facilitate the vertical locking of coupled panels. In order to couple two panels with such "closed groove", at least one of the coupling parts may deform at least partially and temporarily. A "closed groove" may thus increase the vertical locking of coupled panels, and may increase the difficulty to couple panels. The angle enclosed by the direction in which the part is inclined and the vertical may for instance lie between 0 and 45 degrees, in particular between 0 and 10 degrees. The angle may exclude 0 degrees, since this would result in a vertical direction and not a direction which can be considered angled. In the "closed groove" systems, vertical locking is typically improved by increasing the angle enclosed, but the greater the angle, the more difficult it is to couple adjacent panels.

At least a part of a side of the upward tongue facing toward the upward flank may inclined with respect to a vertical direction and may be angled away from the upward flank; and wherein at least a part of a side of the downward tongue facing toward the downward flank may be inclined with respect to a vertical direction. The part of the side of the downward tongue being inclined with respect to the vertical direction may be angled away from the downward flank. This angling and inclination creates a so-called "open groove" system, which is relatively easy to couple, as well as uncouple, and does not require deformation of the coupling parts (or at least not as much as in a "closed groove"). The angle enclosed by the direction in which the part is inclined and the vertical may for instance lie between 0 and 45 degrees, in particular between 0 and 10 degrees. The angle may exclude 0 degrees, since this would result in a vertical direction and not a direction which can be considered angled. Hence, preferably the (complete) side of the upward tongue facing toward the upward flank is upwardly inclined in a direction away from the upward flank, and wherein the (complete) side of the downward tongue facing toward the downward flank is downwardly inclined in a direction away from the downward flank.

Preferably, a horizontal centreline of the third locking element and/or a horizontal centreline of the fourth locking element is situated in between (i) a horizontal centreline (L1) of the first locking element and (ii) a horizontal line (LH) defining the maximum height of the upward tongue. This specific location of the third locking element and/or fourth locking element is favourable firstly because this leads to a relatively low position of the third locking element and/or fourth locking element, which prevents gap formation in between coupled panels and which secures a closed seam between coupled panels. Secondly, by positioning at least a part of the third locking element and/or at least a part of fourth locking element above at least a part of the first locking element (and typically also above at least a part of the second locking element), the overall material deformation during coupling can be kept limited, which reduces the material stress increase during coupling, and which is in favour of the reliability of durability of the coupling realized between the panels. Typically, though not necessarily, the horizontal centreline of the third locking element coincides with the horizontal centreline of the fourth locking element. The horizontal centreline is a fictive line crossing the centre (heart) of a defined locking element, and extends within and/or is parallel to a plane defined by the panel as such. The horizontal line (LH) defining the maximum height of the upward tongue is also a fictive line touch the top of the upward tongue, wherein also this line extends within and/or is parallel to a plane defined by the panel as such. Preferably, the horizontal centreline of the third locking element and/or the horizontal centreline of the fourth locking element is situated in between (i) the horizontal centreline of the second locking element and (ii) the horizontal line defining the maximum height of the upward tongue. Typically, though not necessarily, the centreline of the first locking element coincides with the centreline of the second locking element.

In a preferred embodiment, at least a part of a side of the downward tongue facing away from the downward flank is provided with a fifth locking element, for instance in the form of an outward bulge or a recess, adapted for co-action with a sixth locking element, for instance in the form of a recess or an outward bulge, of an adjacent floor panel, and wherein at least a part of the upward flank is provided with a sixth locking element, for instance in the form of a recess or an outward bulge, adapted for co-action with the fifth locking element, for instance in the form of an outward bulge or a recess, of an adjacent floor panel. The presence of a fifth locking element and (complementary) sixth locking element will improve the desired vertical locking effect between two panels in coupled condition. Preferably, one locking element of the third locking element and the fifth locking element is formed by a bulge and one other locking element of the third locking element and fifth locking element is formed by a recess. And preferably, one locking element of the fourth locking element and the sixth locking element is formed by a bulge and one other locking element of the fourth locking element and sixth locking element is formed by a recess. More preferably, third locking element is formed by a bulge while the (adjacent) fifth locking element is formed by a recess, while the fourth locking element is formed by a recess and the sixth locking element is formed by a bulge. In this manner, the contour formed by the third locking element and the fifth locking element will have a substantially sigmoid shape ("S"-shape or "Z"-shape). Here, the contour formed by the fourth locking element and the sixth locking element will have a mirror-inverted (complementary) sigmoid shape (inverted "S"-shape or inverted "Z"-shape). It is noted that he third locking element and fifth locking element (thus) could have different shapes. It is also noted that the fourth locking element and sixth locking element (thus) could have different shapes. Preferably, a centreline of the fifth locking element and a centreline of the sixth locking element are situated above a centreline of the third locking element.

Preferably, the fifth locking element and/or sixth locking element is/are located at a higher level than all other locking elements. Preferably, a horizontal centreline of the fifth locking element and/or a horizontal centreline of the sixth locking element is/are situated in between (i) the horizontal centreline (L1) of the first locking element and (ii) the horizontal line (LH) defining the maximum height of the upward tongue. This specific location of the fifth locking element and/or sixth locking element is favourable firstly because this leads to a relatively low position of the fifth locking element and/or sixth locking element, which prevents gap formation in between coupled panels and which secures a closed seam between coupled panels. Secondly, by positioning at least a part of the fifth locking element and/or at least a part of sixth locking element above at least a part of the first locking element (and typically also above at least a part of the second locking element), the overall material deformation during coupling can be kept limited, which reduces the material stress increase during coupling, and which is in favour of the reliability of durability of the coupling realized between the panels.

Typically, the first locking element and the second locking element have complementary shapes. Typically, the third locking element and the fourth locking element have complementary shapes. Typically, the fifth locking element and the sixth locking element (if applied) have complementary shapes.

In a preferred embodiment, the transition between the side of the upward tongue facing away from the upward flank, and the upper side of the upward tongue, defines a convex vertex, and wherein a centreline of the fourth locking element substantially coincides with a centreline of said convex vertex. Aforementioned transition may be a concrete point (or concrete corner) where said two sides (the upper side and the outer (distant) side of the upward tongue) meet each other, or may be a—typically curved—area (or zone or region) connecting said two sides of the upward tongue. In case the transition is formed by an area (or zone or region), a centre (point) of said zone may, for example, be considered as convex vertex. Preferably, the convex vertex is defined by a transition between a flat, preferably vertically oriented, part of the side of the upward tongue facing away from the upward flank, and a flat, preferably inclined, part of the upper side of the upward tongue. In this preferred embodiment, the transition is a clear corner where the two sides meet each other, wherein the convex vertex coincides with said corner.

In a preferred embodiment, the transition between the downward flank and the upper side of the downward groove defines a concave vertex, and wherein a centreline of the third locking element is situated in between a centreline of said concave vertex and a centreline of said second locking element. Also in the case, aforementioned transition may be a concrete point (or concrete corner) where said two sides (the upper side of the downward groove, and the downward flank) meet each other, or may be a—typically curved—area (or zone or region) connecting said two sides. In case the transition is formed by an area (or zone or region), a centre (point) of said zone may, for example, be considered as concave vertex. Preferably, the transition between the downward flank and the upper side of the downward groove defines a concave vertex, and wherein the centreline of the third locking element substantially coincides with a centreline of said concave vertex.

At least a part of, and preferably the complete, upper side of the upward tongue is inclined downwardly in a direction facing way from the upward flank. Preferably, at least a part of, and preferably the complete, upper side of the downward groove is inclined downwardly towards the downward flank. Preferably, both inclinations mutually enclose an angle between (and including) 0 and 5 degrees. The inclination of the upper side of the upward tongue is preferably situated between 15 and 45 degrees, more preferably between 25 and 35 degrees, and is most preferably about 30 degrees, with respect to a horizontal plane (being a plane defined by the panel). The inclination of the upper side of the upward tongue is preferably constant, which means the upper side has a substantially flat orientation. Preferably, the upper side of the downward groove has a, preferably likewise (compared to the inclination of the upper side of the upward tongue) inclining orientation, which is more preferably upward in the direction of the downward tongue. A lower surface of a bridge connecting the downward tongue to the core (main body) of the panel is defined by the upper side of the downward groove. Applying an inclined upper side of the downward groove will result in a varying thickness of the bridge, as seen from the core in the direction of the downward tongue. This position-dependent bridge thickness, wherein the bridge thickness is preferably relatively large close to the core and relatively small close to the downward tongue, bridge thickness has multiple advantages. The thicker part of the bridge, close to the core, provides the bridge more and sufficient strength and robustness, while the thinner part of the bridge, close to the downward tongue, forms the weakest point of the bridge and will therefore be decisive for the location of first deformation (pivoting point) during coupling. Since this point of deformation is located close to the downward tongue the amount of material to be deformed to be able to insert the downward tongue into the upward groove can be kept to a minimum. Less deformation leads to less material stress which is in favour of the life span of the coupling profile(s) and hence of the panel(s).

Preferably, the side of the upward tongue facing away from the upward flank comprises two substantially vertical side parts, wherein the first locking element is situated in between said substantially vertical side parts. Preferably, the downward flank comprises two substantially vertical side parts, wherein the second locking element is situated in between said substantially vertical side parts. In coupled condition, preferably at least one vertical side part of the side of the upward tongue facing away from the upward flank engages at least one vertical side part of the downward flank. This will commonly provide more stability and robustness to the realized coupling between the panels.

The part of the side of the downward tongue facing away from the downward flank and/or at least a part of the upward flank may be at least partially curved or inclined, wherein the third and/or fourth locking element may be located on the at least partially curved or inclined part. Such curved or inclined part may for instance for an aligning edge, facilitating mutual alignment of panels to be coupled. The first and second coupling parts may for instance comprise a bridge part, connecting the upward and downward tongues to the respective flanks. The curve or inclination of the part of the side of the downward tongue facing away from the downward flank and/or at least a part of the upward flank may be towards the bridge part of the coupling part.

An upper part of the upward flank and/or an upper part of the side of the downward tongue facing away from the downward flank may be provided with a bevel. The upper parts are for instance in contact at a lower zone of the upper parts, and are moving away from each other in a higher zone of the upper parts, forming the bevel. Such bevel provides both a space for movement around the upper parts, as well as an aesthetic effect simulating wooden flooring panels.

When such bevels are provided on the upper parts of the coupling parts, in a coupled state the bevels form a V-shape (of removed material). The third and fourth locking elements are then, preferably, located at a level lower than, or beneath, the lowest part of the bevels. In this way, the third and fourth locking elements are not visible from above, when the panels are coupled.

The third locking element may be located inward compared to an upper part of the side of the downward tongue facing away from the downward flank. The upper part of the side of the downward tongue may thus form an extremity, or furthest part, of the locking element, and the other elements of the second coupling element may be arranged between the core of the panel and said upper part, resulting in a relative compact design. Such compact design has further benefits in that the elements thereof are protected and not as vulnerable to damage compared to protruding elements.

The third locking element may be an outward bulge, and the fourth locking element may be a recess, wherein in particular the outward bulge may be at least partially circular in cross section. It may also be that the third locking element is a recess, and the fourth locking element is an outward bulge. The recess may be shaped such to be substantially complementary to the bulge, which also holds for the first and second locking elements as well. A bulge/recess combination is relatively easy to manufacture, and thus relatively easy to produce.

Between the downward tongue and the core of the panel a bridge part may be present, connecting the downward tongue to the core, wherein, in particular, the bridge part may have a variable thickness between the core and the downward tongue. Such variable thickness of the bridge part results in a bridge part having a section with a minimum thickness, or a section wherein the thickness of the bridge part is minimal. It is that section where the least amount of material is present in the bridge, such that said section forms a weakest zone of the bridge part. Especially in so-called "closed groove" locking systems, where (at least temporary) deformation of the coupling parts occurs, the formation or characterization of such weakest zone defines the location where deformation of the coupling parts, and the bridge thereof in particular, is most likely to occur. The second coupling part may thus configured to deform at least temporary during coupling, in particular the bridge part of the second coupling part.

The minimal thickness of the second coupling part, in particular the bridge thereof, may be less than half the total thickness of the panel. By having such minimal thickness of the second coupling part, a relative thin zone is created in the second coupling part. This thin zone is especially useful in the "closed groove" systems, where (at least temporary) deformation of the coupling parts occurs, the formation or characterization of such thin zone defines the location where deformation of the coupling parts, and the bridge thereof in particular, is most likely to occur. The second coupling part may thus configured to deform at least temporary during coupling, in particular the bridge part of the second coupling part.

At least one third locking element and at least one fourth locking element may be arranged at a higher level compared to the level of the first and second locking elements. Also, at least one third locking element and at least one fourth locking element may be arranged at a lower level compared to the highest point of the upward tongue. Also, the third and fourth locking elements may be arranged, at least in vertical direction, between the highest point of the upward tongue and the level of the first and second locking elements. This distribution may result in a vertical separation of locking elements. Such separation is beneficial since, for instance upon coupling by a vertical motion, the locking elements which co-act together to provide locking, are coupled in turn, one after the other. This may reduce deformation and material stresses in these locking elements. Additionally the reduction in these forces increases the strength of the locking elements.

In a coupled condition, a gap may be present between the upper side of the upward tongue and the upper side of the downward groove, wherein the gap preferably widens from the side of the upward tongue facing towards the upward flank to the downward flank. The presence of a gap between the upper side of the upward tongue and the upper side of the downward groove results in that the upward tongue and the downward groove are, as such, not in direct contact. Instead, the inside and outside of the tongues are on contact. The gap allows foreign material to collect, without hindering the coupling of panels. The gap also allows panel material to collect when such material is for instance shaved of the coupling parts during coupling. Such may occur when, due to for instance production tolerances, one of the coupling parts is slightly over dimensioned compared to the available space.

Beneath the first coupling element, in particular beneath the upward tongue thereof, a space may be present, such that, when placed on the floor, a gap exists between the upward tongue and the floor the panel is placed on. This space may for instance increase in height in a direction from the core towards the outside of the upward tongue, or the side of the upward tongue facing away from the upward flank. A space underneath the first coupling element may allow the first coupling element to deform, or bend, slightly downward during coupling, facilitating coupling of two panels. This facilitation of coupling further allows larger tolerances and deviations from the exact dimensions of the coupling parts to be coupled.

In a coupled condition, a plurality of gaps may be present between the coupling parts of the coupled panels. For instance, a first gap may be present between the upper parts of the coupling parts and the third and fourth locking elements. A second gap may be present between the third and second locking elements and the inner sides of the tongues (or the side of the upward tongue facing towards the upward flank and the side of the downward tongue facing towards the downward flank). A third gap may be present between the inner sides of the tongues (or the side of the upward tongue facing towards the upward flank and the side of the downward tongue facing towards the downward flank) and the first and second locking elements. The presence of these gaps between the upper side of the upward tongue and the upper side of the downward groove results in that the upward tongue and the downward groove are, as such, not in direct contact. Instead, the inside and outside of the tongues are on contact. The gap allows foreign material to collect, without hindering the coupling of panels. The gap also allows panel material to collect when such material is for instance shaved of the coupling parts during coupling. Such may occur when, due to for instance production tolerances, one of the coupling parts is slightly over dimensioned compared to the available space.

The panel according to the invention is typically used to provide a floor covering, but can also be applied to form an alternative covering, for example a wall covering, ceiling covering, column covering, beam covering, or furniture covering. The panel may have a thickness between 2.5 and 10 mm thick. At least a part of the core may be made of any material, such as MDF, HDF, particle board, plastic, such as PVC, PE, PP, PET, PU, (wood) plastic composites, mineral board, magnesium oxide board, gypsum, glass, sand, wood, or mixtures (or combinations) thereof. The panel may further be provided with one or more reinforcement layers, such as a glass fibre layer or polyester layer, to strengthen the panel. The panel may for instance be elongated, and have a width between 10 and 100 cm, and a length of 50 to 250 cm.

At least a part of the core of the panels is preferably made of a—relative environmentally friendly—material comprising plastic material, such as polyethylene (PE), polypropylene (PP), polyethylene terephthalate (PET) or polyurethane (PU), polylactic acid (PLA), polybutylene succinate (PBS), polyester, preferably a compostable polyester, or combinations thereof. The core may include filling materials, such as mineral fillers, such as particles, dust, and/or fibres. The panel, in particular the core, may further comprise plasticizer to make the panel as such more flexible. The core of the panel may at least partially be made of a wood fibre core, for instance a recycled wood fibre core.

On top of the core, the panels may comprise a decorative layer, for instance a decorative print layer, preferably made of plastic and/or paper, or a decorative print printed directly on the core. On top of the decorative layer, a protective layer may be present, to protect the decorative layer. On the bottom of the core a balancing or (sound) dampening layer may be present.

The decorative layer may include, for example, paper. The paper may be a printed melamine impregnated paper, for example, a decor sheet composed of melamine resin impregnated cellulose fibres. The paper may be placed directly on the carrier, for example, an HDF board. The paper may be placed on a scattering of decorative powder mix. For example, the decorative powder may include wood fibres and a binder, and optionally, a pigment and/or wear resistant particles. The wood fibres of the decorative power may be processed wood fibres or unprocessed wood fibres, such as recycled wood fibres.

The decorative layer may include, for example, a scattering of decorative powder mix. For example, the decorative powder may include wood fibres and a binder, and optionally, a pigment and/or wear resistant particles. The wood fibres of the decorative power may be processed wood fibres or unprocessed wood fibres, such as recycled wood fibres. The decorative layer may include, for example, multiple layers of scattered decorative powder mix.

The decorative layer may include, for example, a wood veneer. The wood veneer may be placed directly on the carrier, for example, an HDF board. The wood veneer may be placed on a scattering of decorative powder mix. For example, the decorative powder may include wood fibres and a binder, and optionally, a pigment and/or wear resistant particles. The wood fibres of the decorative power may be processed wood fibres or unprocessed wood fibres, such as recycled wood fibres.

The decorative layer may include, for example, cork. The cork may be placed directly on the carrier, for example, an HDF board. The cork may be placed on a scattering of decorative powder mix. For example, the decorative powder may include wood fibres and a binder, and optionally, a pigment and/or wear resistant particles. The wood fibres of the decorative power may be processed wood fibres or unprocessed wood fibres, such as recycled wood fibres.

The transitions between the bridge parts and the tongues of the coupling parts may for instance be rounded or smooth (at least not sharp). Such transitions provide a graduate transition between the different elements, and prevents formation of cracks or material weaknesses at the transitions when loads or forces are applied to the coupling parts. The transitions between the bridge parts and the flanks of the coupling parts may also be rounded or smooth for the same reasons.

The panels may for instance be configured to be coupled with a vertical motion. The panels according to the present invention may for instance be provided with first and second coupling parts on two opposite sides of the panel. For instance, the panel may be elongated or rectangular, and the first coupling part on a short edge thereof. The second coupling part may then be located on the opposite short edge. The other sides, such as the long sides, may be provided with first and second coupling parts as well. Alternatively, the other sides may be provided with angling down profiles, which are coupled by a turning or rotational movement. Such angling down profiles for instance have a sideward groove on one of the sides, and a sideward tongue on the opposite side. The first and second coupling parts are typically suitable to be coupled during this angling motion of the other sides, wherein the first and second coupling parts zip into place in a rotational downward motion, also referred to as "zip-lock". Additionally, the panels according to the invention may be uncoupled using an angling motion.

The invention also related to a covering, in particular a floor covering or wall covering, comprising a plurality of panels according to the present invention.

Further preferred embodiments of the invention are illustrated in the non-limitative clauses below:

1. Panel, in particular a floor panel or wall panel, comprising:

a centrally located core provided with an upper side and a lower side, which core defines a plane;

at least one first coupling part and at least one second coupling part connected respectively to opposite edges of the core, which first coupling part comprises an upward tongue, at least one upward flank lying at a distance from the upward tongue and an upward groove formed in between the upward tongue and the upward flank wherein the upward groove is adapted to receive at least a part of a downward tongue of a second coupling part of an adjacent panel:

which second coupling part comprises a downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel;

wherein at least a part of a side of the upward tongue facing away from the upward flank is provided with a first locking element, for instance in the form of an outward bulge or a recess, adapted for co-action with a second locking element, for instance in the form of a recess or an outward bulge, of an adjacent floor panel;

wherein at least a part of a side of the downward flank is provided with a second locking element, for instance in the form of a recess or an outward bulge, adapted for co-action with the first locking element, for instance in the form of an outward bulge or a recess, of an adjacent floor panel;

wherein at least a part of a side of the downward tongue facing away from the downward flank is provided with a third locking element, for instance in the form of an outward bulge or a recess, adapted for co-action with a fourth locking element, for instance in the form of a recess or an outward bulge, of an adjacent floor panel; and wherein at least a part of the upward flank is provided with a fourth locking element, for instance in the form of a recess or an outward bulge, adapted for co-action with the third locking element, for instance in the form of an outward bulge or a recess, of an adjacent floor panel.

2. Panel according to clause 1, wherein the side of the upward tongue facing toward the upward flank is upwardly inclined in a direction away from the upward flank, and wherein the side of the downward tongue facing toward the downward flank is downwardly inclined in a direction away from the downward flank, 3. Panel according to clause 1 or 2, wherein a horizontal centreline of the third locking element and/or a horizontal centreline of the fourth locking element is situated in between (i) a horizontal centreline (L1) of the first locking element and (ii) a horizontal line (LH) defining the maximum height of the upward tongue.

4. Panel according to one of the foregoing clauses, wherein a horizontal centreline of the third locking element and/or a horizontal centreline of the fourth locking element is situated in between (i) the horizontal centreline (L1) of the second locking element and (ii) the horizontal line (LH) defining the maximum height of the upward tongue.

5. Panel according to one of the foregoing clauses, wherein at least a part of a side of the downward tongue facing away from the downward flank is provided with a fifth locking element, for instance in the form of an outward bulge or a recess, adapted for co-action with a sixth locking element, for instance in the form of a recess or an outward bulge, of an adjacent floor panel, and wherein at least a part of the upward flank is provided with a sixth locking element, for instance in the form of a recess or an outward bulge, adapted for co-action with the fifth locking element, for instance in the form of an outward bulge or a recess, of an adjacent floor panel, 6. Panel according to clause 5, wherein one locking element of the third locking element and the fifth locking element is formed by a bulge and one other locking element of the third locking element and fifth locking element is formed by a recess.

7. Panel according to clauses 5 or 6, wherein one locking element of the fourth locking element and the sixth locking element is formed by a bulge and one other locking element of the fourth locking element and sixth locking element is formed by a recess.

8. Panel according to one of clauses 5-7, wherein the third locking element and fifth locking element have different shapes, and/or wherein the fourth locking element and sixth locking element have different shapes.

9. Panel according to one of clauses 5-8, wherein a centreline of the fifth locking element and a centreline of the sixth locking element are situated above a centreline of the third locking element.

10. Panel according to one of clauses 5-9, wherein a centreline of the fifth locking element and/or a centreline of the sixth locking element are situated in between (i) the horizontal centreline (L1) of the first locking element and (ii) the horizontal line (LH) defining the maximum height of the upward tongue.

11. Panel according to one of the foregoing clauses, wherein the transition between the side of the upward tongue facing away from the upward flank, and the upper side of the upward tongue, defines a convex vertex, and wherein a centreline of the fourth locking element substantially coincides with a centreline of said convex vertex.

12. Panel according to clause 11, wherein the convex vertex is defined by a transition between a flat, preferably vertically oriented, part of the side of the upward tongue facing away from the upward flank, and a flat, preferably inclined, part of the upper side of the upward tongue.

13. Panel according to one of the foregoing clauses, wherein the transition between the downward flank and the upper side of the downward groove defines a concave vertex, and wherein a centreline of the third locking element is situated in between a centreline of said concave vertex and a centreline of said second locking element.

14. Panel according to clause 13, wherein the transition between the downward flank and the upper side of the downward groove defines a concave vertex, and wherein a centreline of the third locking element substantially coincides with a centreline of said concave vertex.

15. Panel according to one of the foregoing clauses, wherein the upper side of the upward tongue is downwardly inclined in a direction away from the upward flank.

16. Panel according to one of the foregoing clauses, wherein the upper side of the downward groove is downwardly inclined in a direction towards the downward flank.

17. Panel according to one of the foregoing clauses, wherein the substantially complete upper side of the upward tongue is flat.

18. Panel according to one of the foregoing clauses, wherein the side of the upward tongue facing away from the upward flank comprises two substantially vertical side parts, wherein the first locking element is situated in between said substantially vertical side parts.

19. Panel according to one of the foregoing clauses, wherein at least a part of a side of the upward tongue facing toward the upward flank is inclined with respect to a vertical direction and is angled towards the upward flank; and wherein at least a part of a side of the downward tongue facing toward the downward flank is inclined with respect to a vertical direction.

20. Panel according to one of the foregoing clauses, wherein at least a part of a side of the upward tongue facing toward the upward flank is inclined with respect to a vertical direction and is angled away from the upward flank; and wherein at least a part of a side of the downward tongue facing toward the downward flank is inclined with respect to a vertical direction.

21. Panel according to any of the foregoing clauses, wherein the part of the side of the downward tongue facing away from the downward flank and/or at least a part of the upward flank is at least partially curved or inclined, wherein the third and/or fourth locking element is located on the at least partially curved or inclined part.

22. Panel according to any of the foregoing clauses, wherein an upper part of the upward flank and/or an upper part of the side of the downward tongue facing away from the downward flank is provided with a bevel, wherein, preferably, the third and fourth locking elements are located at a distance from the lowest part of the bevel.

23. Panel according to any of the foregoing clauses, wherein the third locking element is located inward compared to an upper part of the side of the downward tongue facing away from the downward flank.

24. Panel according to any of the foregoing clauses, wherein the third locking element is an outward bulge, and the fourth locking element is a recess, wherein in particular the outward bulge is at least partially circular in cross section.

25. Panel according to any of the foregoing clauses, wherein between the downward tongue and the core of the panel a bridge part is present, connecting the downward tongue to the core, wherein, in particular, the bridge part has a variable thickness between the core and the downward tongue.

26. Panel according to any of the foregoing clauses, wherein the third and fourth locking elements are arranged at a higher level compared to the level of the first and second locking elements.

27. Panel according to any of the foregoing clauses, wherein the third and fourth locking elements are arranged at a lower level compared to the highest point of the upward tongue.

28. Panel according to any of the foregoing clauses, wherein the third and fourth locking elements are arranged, at least in vertical direction, between the highest point of the upward tongue and the level of the first and second locking elements.

29. Panel according to any of the foregoing clauses, wherein the third and fourth locking elements are adapted for co-action to provide a vertical locking and/or wherein the first and second locking elements are adapted for co-action to provide a vertical locking.

30. Panel according to any of the foregoing clauses, wherein the second coupling part is configured to deform at least temporary during coupling, in particular the bridge part of the second coupling part.

31. Panel according to any of the foregoing clauses, wherein, in a coupled condition, a gap is present between the upper side of the upward tongue and the upper side of the downward groove, wherein the gap preferably widens from the side of the upward tongue facing towards the upward flank to the downward flank.

32. Panel according to any of the foregoing clauses, wherein the minimal thickness of the second coupling part, in particular the bridge thereof, is less than half the total thickness of the panel.

33. Panel according to any of the foregoing clauses, wherein beneath the first coupling element, in particular beneath the upward tongue thereof, a space is present, such that, when placed on the floor, a gap exists between the upward tongue and the floor the panel is placed on.

34. Covering, in particular a floor covering or wall covering, comprising a plurality of interconnected panels according to any of the foregoing clauses.

BRIEF DESCRIPTION OF THE DRAWINGS

The invention will be elucidated on the basis of non-limitative exemplary embodiments shown in the following figures. Herein.

DESCRIPTION OF THE INVENTION

Figure 1:
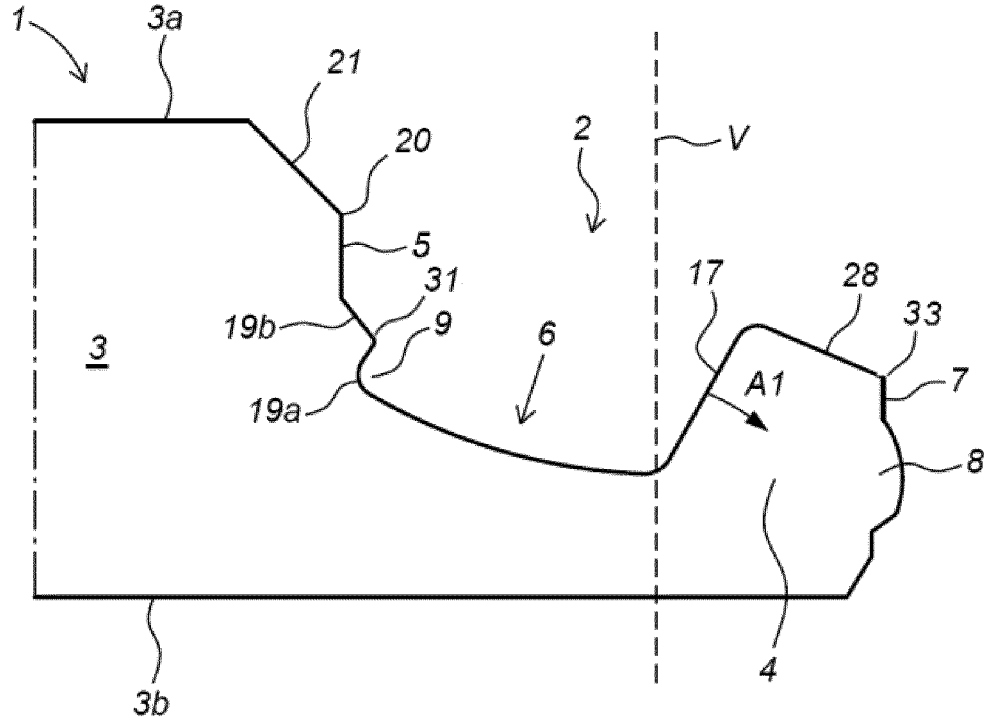
FIG. 1 schematically shows a panel according to the present invention, and shows the first coupling part of the panel.

FIG. 1 schematically shows a floor panel (1) according to the present invention, and shows the first coupling part (2) of the panel (1). The panel (1) comprises a centrally located core (3) provided with an upper side (3*a*) and a lower side (3*b*). The first coupling part (2) comprises an upward tongue (4), an upward flank (5), lying at a distance from the upward tongue (4) and an upward groove (6) formed in between the upward tongue (4) and the upward flank (5). The upward groove (6) is adapted to receive at least a part of a downward tongue of a second coupling part of an adjacent panel.

A part of a side (7) of the upward tongue (4) facing away from the upward flank (5) is provided with a first locking element (8), in the form of an outward bulge (8), adapted for co-action with a second locking element of an adjacent floor panel.

A part of the upward flank (5) is provided with a fourth locking element (9), in the form of a recess (9), adapted for co-action with the third locking element of an adjacent floor panel. A part of a side (17) of the upward tongue (4) facing toward the upward flank (5) is inclined with respect to a vertical direction (V) and is angled away from the upward flank (5), indicated with an arrow (A1). A part (19) of the upward flank (5) is curved (19*a*) or inclined (19*b*), wherein the fourth locking element (9) is located on the curved (19*a*) or inclined (19*b*) part. An upper part (20) of the upward flank (5) is provided with a bevel (21).

Figure 2:
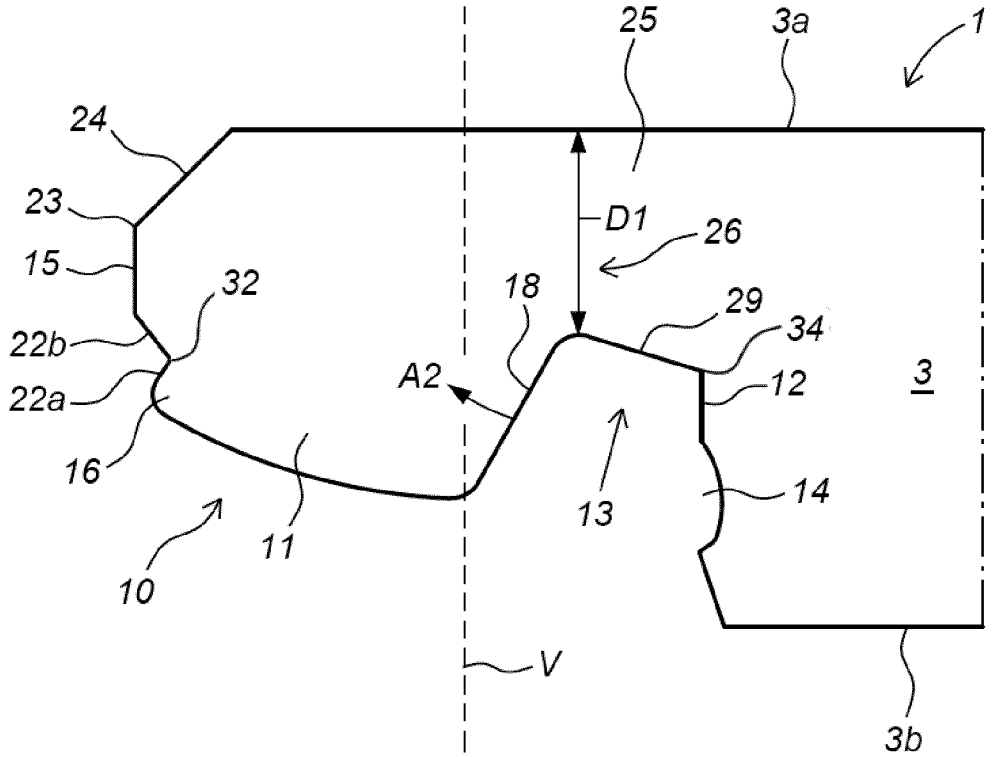
FIG. 2 schematically shows a panel according to the present invention, and shows the second coupling part of the panel.

FIG. 2 schematically shows a floor panel (1) according to the present invention, and shows the second coupling part (10) of the panel (1). The panel (1) comprises a centrally located core (3) provided with an upper side (3*a*) and a lower side (3*b*). The second coupling part (10) comprises a downward tongue (11), a downward flank (12) lying at a distance from the downward tongue (11), and a downward groove (13) formed in between the downward tongue (11) and the downward flank (12) wherein the downward groove (11) is adapted to receive at least a part of an upward tongue of a first coupling part of an adjacent panel.

A part of a side of the downward flank (12) is provided with a second locking element (14), in the form of a recess (14), adapted for co-action with the first locking element of an adjacent floor panel. A part of a side (15) of the downward tongue (11) facing away from the downward flank (12) is provided with a third locking element (16), in the form of an outward bulge (16), adapted for co-action with a fourth locking element of an adjacent floor panel.

A part of a side (18) of the downward tongue (11) facing toward the downward flank (12) is inclined with respect to a vertical direction (V) and is angled away from the downward flank (12), indicated with an arrow (A2). A part of the side (15) of the downward tongue (11) facing away from the downward flank (12) is curved (22*a*) or inclined (22*b*), wherein the third locking element (16) is located on the curved (22*a*) or inclined (22*b*) part. An upper part (23) of the side (15) of the downward tongue (11) facing away from the downward flank (12) is provided with a bevel (24). The third locking element (16) is located inward compared to the upper part (23) of the side (15) of the downward tongue (11) facing away from the downward flank (12).

The upward flank (5) is also provided with a sixth locking element (31), in the form of a an outward bulge (31), adapted for co-action with the fifth locking element (32), in the form of a recess (32) of an adjacent floor panel (1). The fourth (9) and sixth (31) locking element are arranged directly below each other in FIG. 1, and together form sort of an Z-shape, or S-shape or zigzag-shape.

The transition (33) between the side (7) of the upward tongue (4) facing away from the upward flank (5), and the upper side (28) of the upward tongue (4), defines a convex vertex (33), and wherein a centreline of the third and fourth locking element substantially coincides with a centreline of said convex vertex.

FIG. 2 shows that between the downward tongue (11) and the core (3) of the panel (1) a bridge part (25) is present, connecting the downward tongue (11) to the core (3), wherein the bridge part (25) has a variable thickness. The thickness of the bridge part (25) has a minimum thickness, indicated with (D1), wherein the bridge part (25), where thickness is minimum, has a thinnest, or weakest, area (26), where possible deformation of the second coupling part (10) is most likely to occur.

A part of a side (18) of the downward tongue (11) facing away from the downward flank (12) is provided with a fifth locking element (32), in the form of a recess (32), adapted for co-action with a sixth locking element (31), in the form of an outward bulge (31), of an adjacent floor panel (1). The third (16) and fifth (32) locking element are arranged directly below each other in FIG. 2, and together form sort of an Z-shape, or S-shape or zigzag-shape.

The transition (34) between the downward flank (12) and the upper side (29) of the downward groove (13) defines a concave vertex (34).

Figure 3:
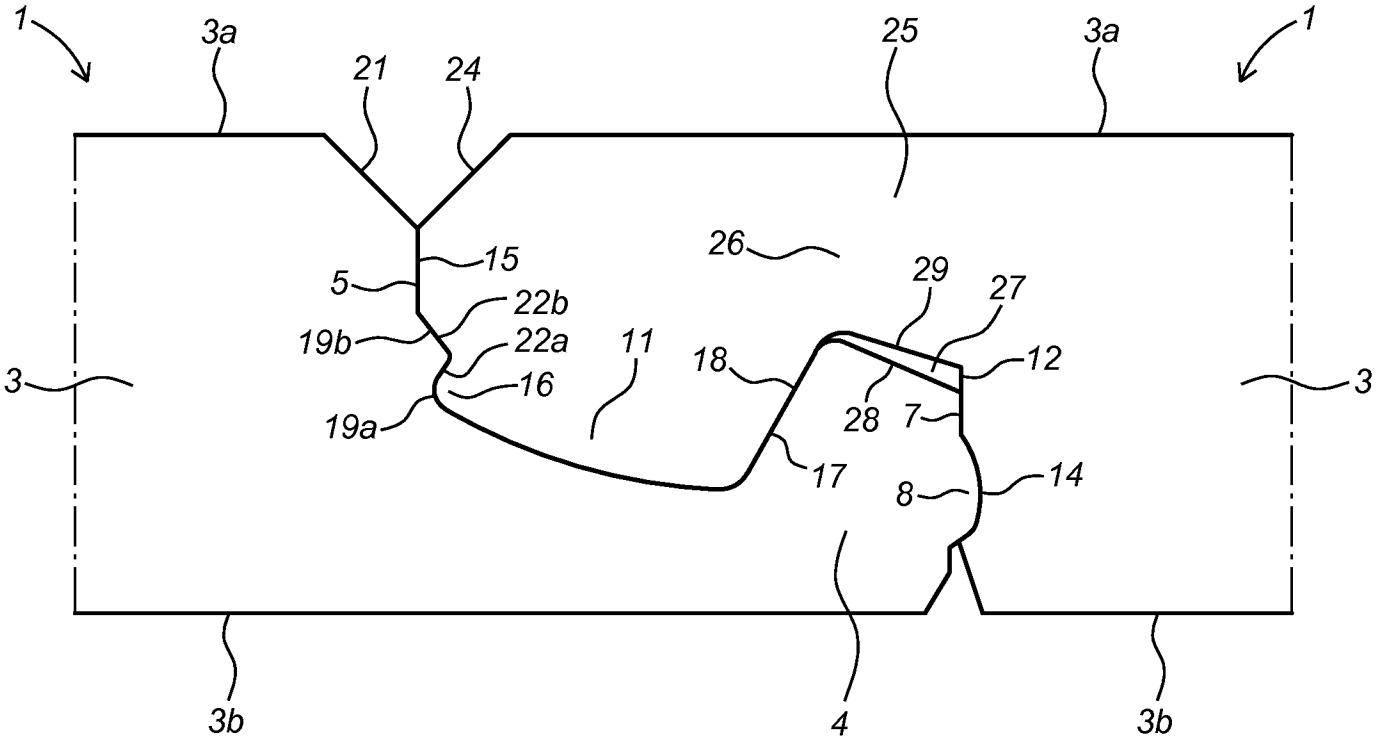
FIG. 3 schematically shows the first and second coupling parts of FIGS. 1 and 2 in coupled condition.

FIG. 3 shows the first and second coupling parts of FIGS. 1 and 2 in a coupled condition. In this coupled condition, a gap (27) is present between the upper side (28) of the upward tongue (4) and the upper side (29) of the downward groove (13), wherein the gap (27) widens from the side (17) of the upward tongue (4) facing towards the upward flank (5) to the downward flank (12).

Figure 4:
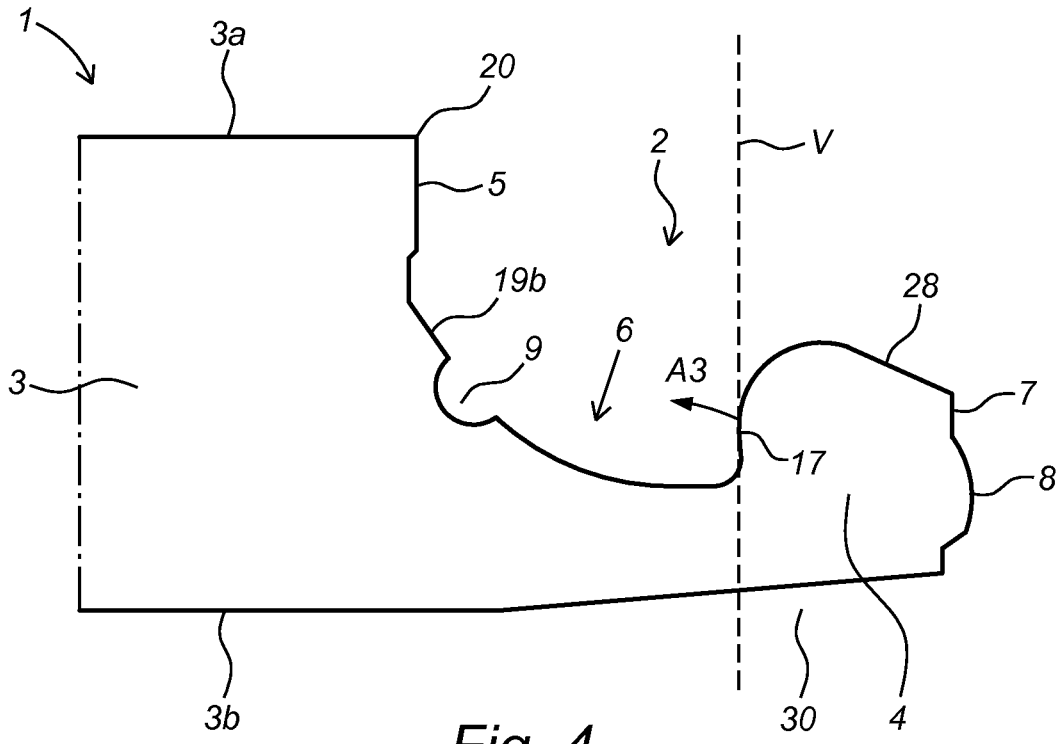
FIG. 4 schematically shows a panel according to the present invention, and shows the first coupling part of the panel.
Figure 5:
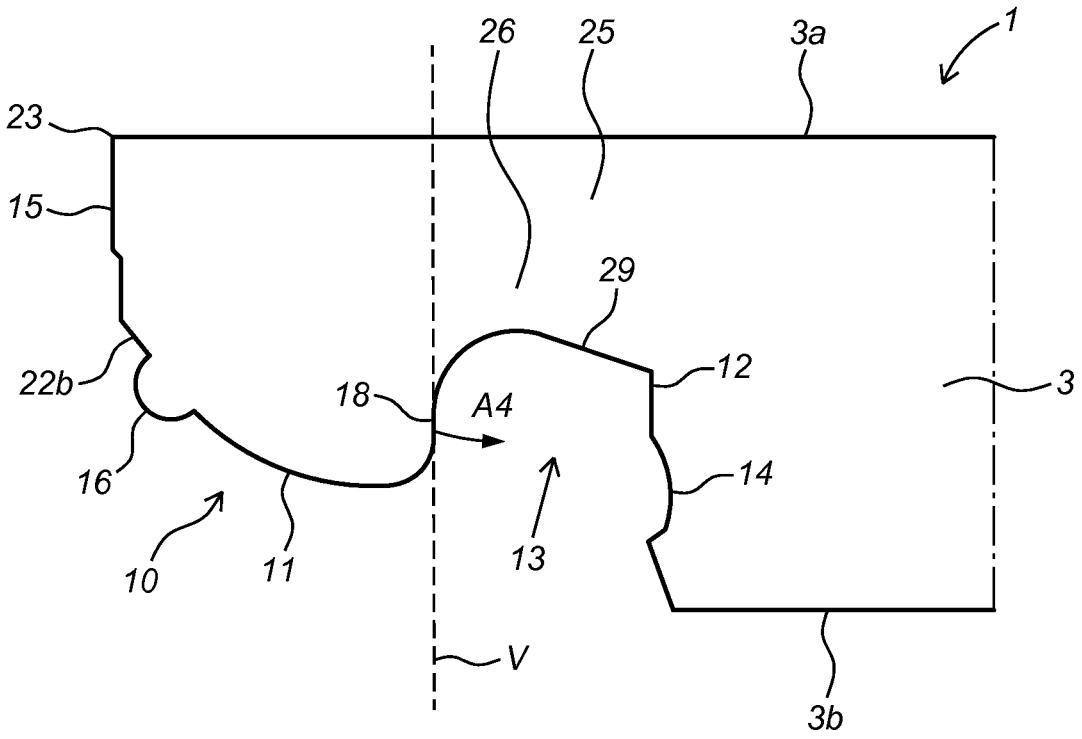
FIG. 5 schematically shows a panel according to the present invention, and shows the second coupling part of the panel.
Figure 6:
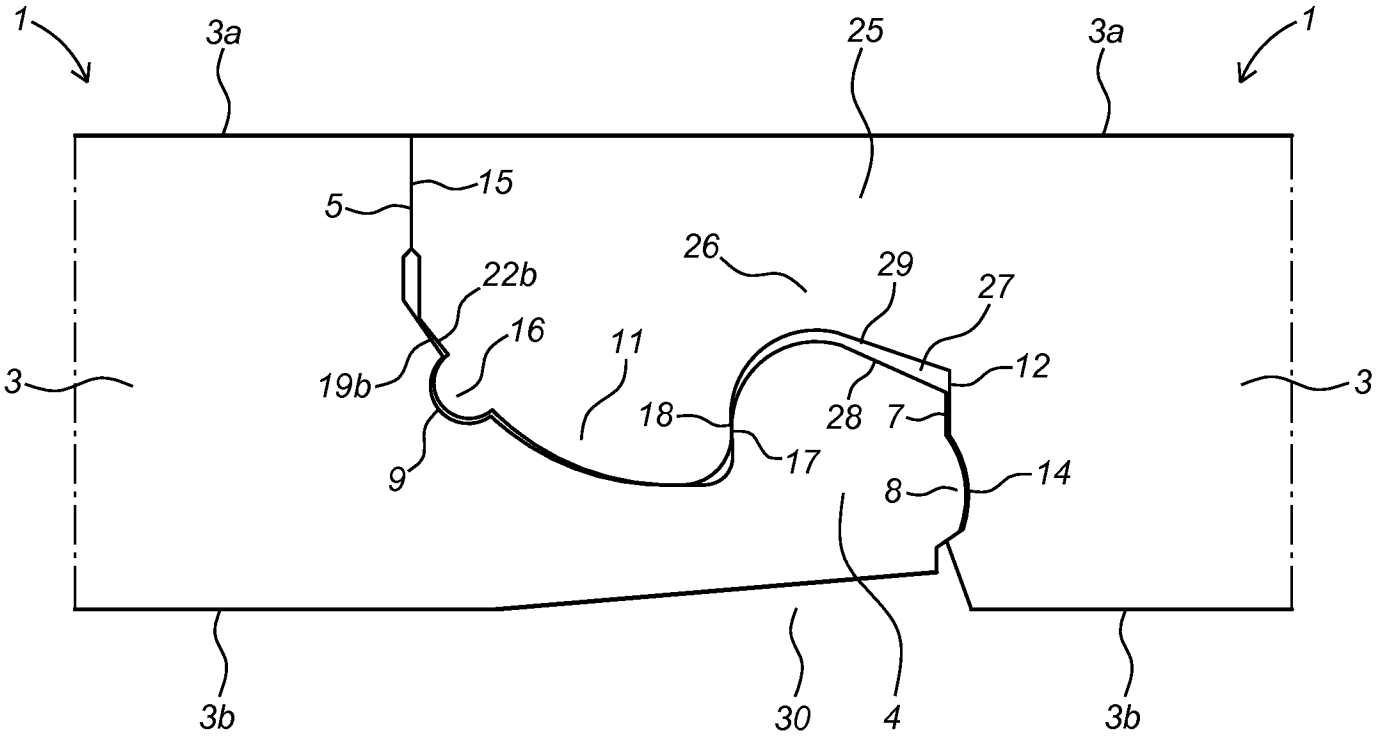
FIG. 6 schematically shows the first and second coupling parts of FIGS. 4 and 5 in coupled condition.

FIGS. 4-6 show a variant to the panel shown in FIGS. 1-3. FIG. 4 shows the first coupling part, FIG. 5 the second coupling part and FIG. 6 a coupled condition.

Features corresponding between FIGS. 1-3 and 4-6 are provided with the same numerals. The main differences is that where FIGS. 1-3 show an "open groove" system, FIGS. 4-6 show a "closed groove" locking system. This is indicated by the arrows (A3 and A4), which show that the sides (17, 18) of the tongues (4, 11) are directed towards the flanks (5, 12), rather than away from the flanks (5, 12). Beneath the upward tongue (4), a space (30) is present, such that, when placed on the floor, a space (30) exists between the upward tongue (4) and the floor the panel is placed on. Although the "closed groove" embodiment is shown, the same, or at least similar, profile can be used in an "open groove" embodiment as well.

Figure 7:
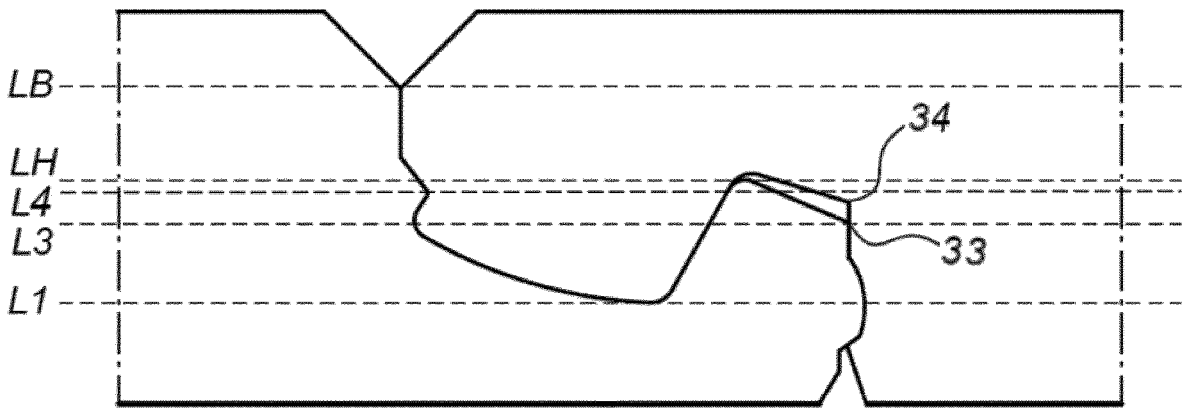
FIG. 7 schematically shows different levels of the embodiment shown in FIGS. 1-3.
Figure 8:
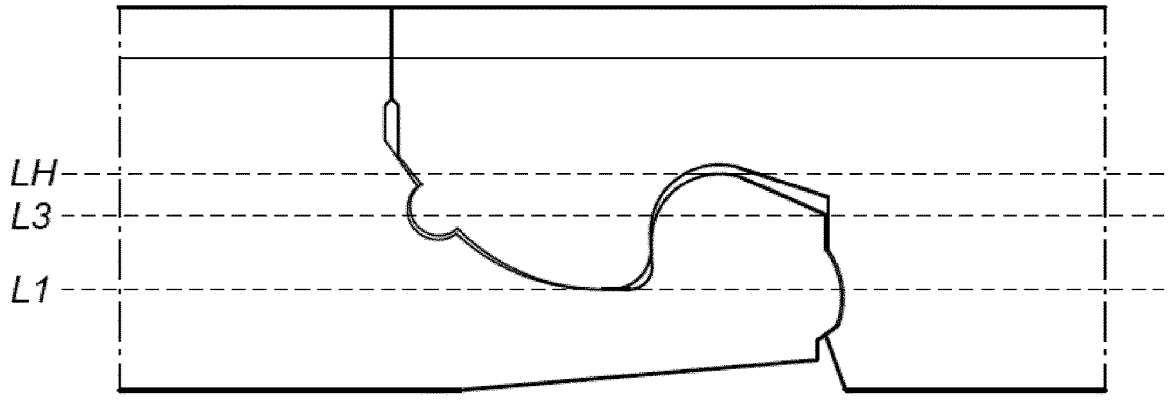
FIG. 8 schematically shows different levels of the embodiment shown in FIGS. 4-6.

FIGS. 7 and 8 show, in a coupled condition, the levels of the first and second locking elements (L1), the third and fourth locking elements (L3) and the highest point of the upward tongue (LH). The level of the third and fourth locking elements (L3) lies between the level of the highest point of the upward tongue (LH) and the level of the first and second locking elements (L1). FIG. 7 also indicates the level of the lowest part of the bevel as (LB). Between that level (LB) and the level of the third and fourth locking elements (L3) a distance exists, such that the third and fourth locking elements are not visible through the bevel. The levels of the locking elements are showing the horizontal centrelines of the locking elements.

In FIG. 7, the centreline (L4) of the fifth and sixth locking elements is indicated, which lies above a the centreline (L3) of the third locking element, above the centreline of the first locking element (L1) and below the level (L3) of the highest point of the upward tongue. The centreline (L3) of the third and/or fourth locking element coincides locally with the transition between the transition (33) between the side (7) of the upward tongue (4) facing away from the upward flank (5), and the upper side (28) of the upward tongue (4), which transition defines a convex vertex (33). The centreline (L3) of the third locking element is situated in between a centreline of the concave vertex (34) and the centreline (L1) of the first and/or second locking element.

Figure 9:
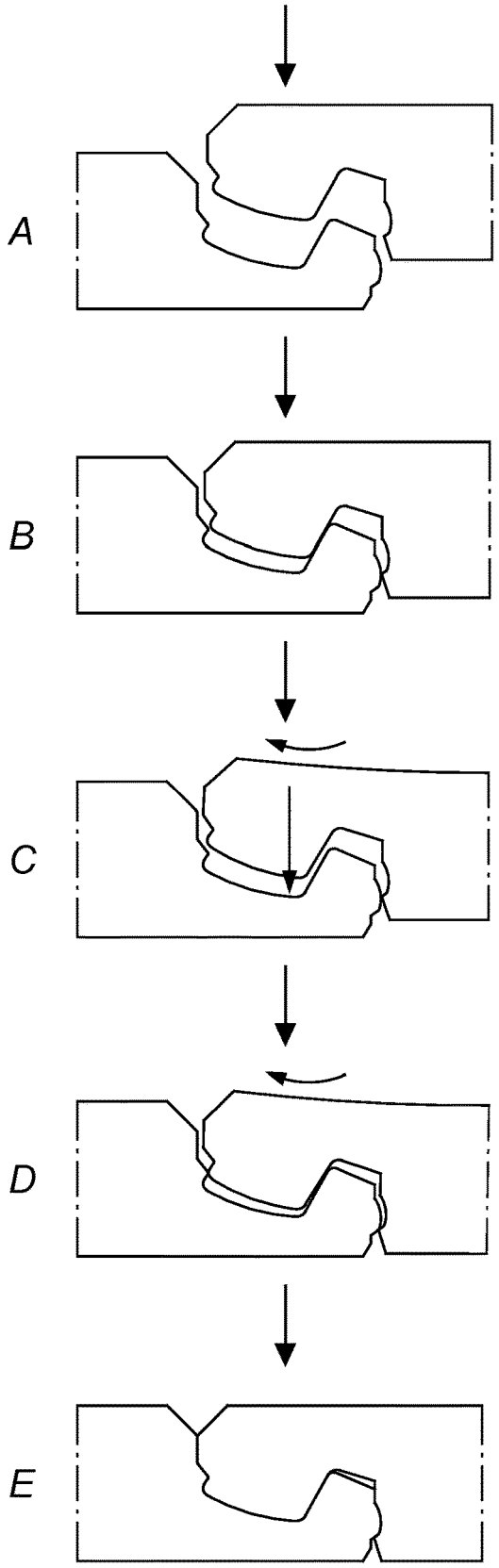
FIG. 9 schematically shows the coupling of two panels as shown in FIGS. 1-3 and 7.
Figure 10:
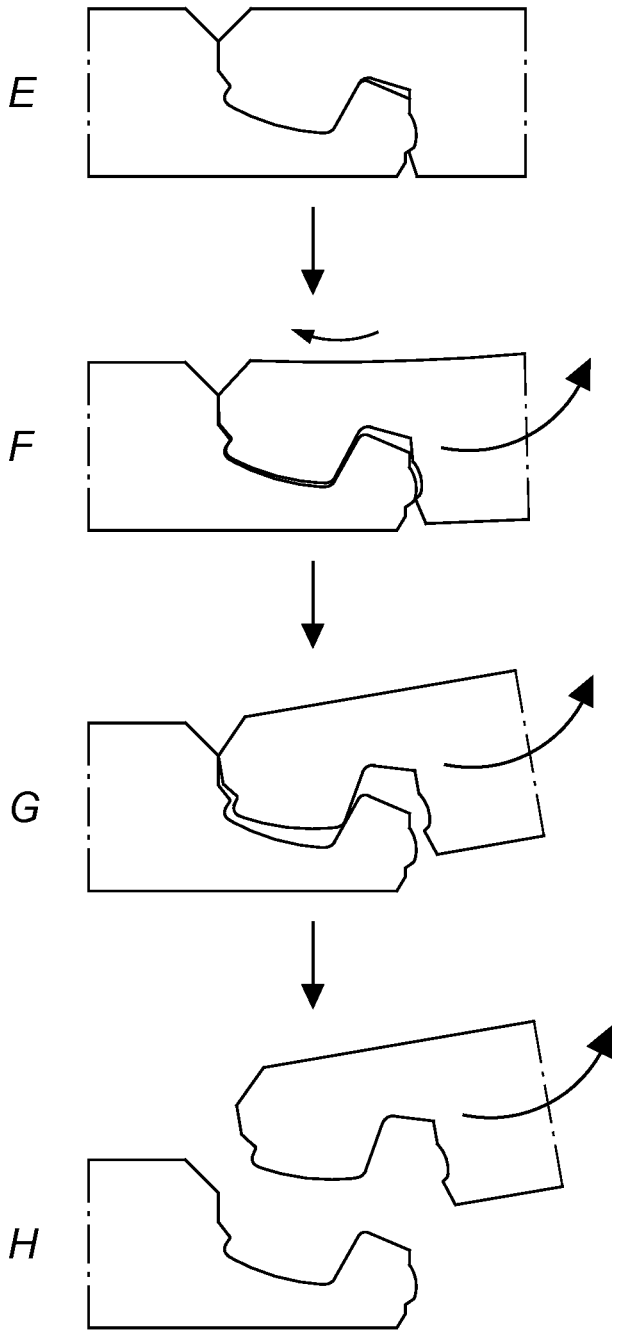
FIG. 10 schematically shows the uncoupling of two panels as shown in FIGS. 1-3 and 7.

FIG. 9 schematically shows the coupling of two panels as shown in FIGS. 1-3 and 7. FIG. 10 schematically shows the uncoupling of two panels as shown in FIGS. 1-3 and 7. FIG. 9 shows coupling by a vertical movement (indicated with the vertical arrow). In step A the panels are moved towards each other. In step B, the first and second locking elements are engaging. In step C, a deformation of the bridge part of the second coupling part occurs, indicated with the curved arrow. In step D, the first and second locking elements are sliding in place, and the third and fourth locking elements are engaging. In step E the coupling is complete. FIG. 10 shows the coupled condition in step E. In step F uncoupling is initiated by a rotation (large arrow), causing a deformation of the bridge part of the second coupling part (small arrow). In step G the coupling is undone, wherein in step H both panels are free from each other, corresponding to step A of FIG. 9.

FIGS. 11A-11J schematically show various alternative embodiments for coupling parts. The coupling parts as described in the previous figures are especially suitable for short sides of elongated panels. These coupling parts are typically on two opposite sides, or two opposite short sides, of such panels. On the other sides, for instance on two opposite long sides of such panels, angling down profiles could be present. FIGS. 11A-11J show various coupling parts which are suitable for using on these opposite sides of the panel. Each of these embodiments can be angled in place, by turning or rotating the sideward tongues (101) into sideward grooves (102). In each of these embodiments also gaps (103) are present in coupled conditions, which can be used to accumulate foreign material such as dust.

The sideward grooves (102) are typically bordered by an upper lip (104) and a lower lip (105) extending beyond the upper lip (104), wherein the upper lip (104) is provided with an upward shoulder (106), which cooperates with a groove typically underneath the sideward tongue (101). In some embodiments the entrance to the groove (102) is angled or chamfered (107). In coupled condition, an intermediate space (108) may be present between the coupling elements, between the outside of the upward shoulder (106) and the core of the panel.

Figure 11A:
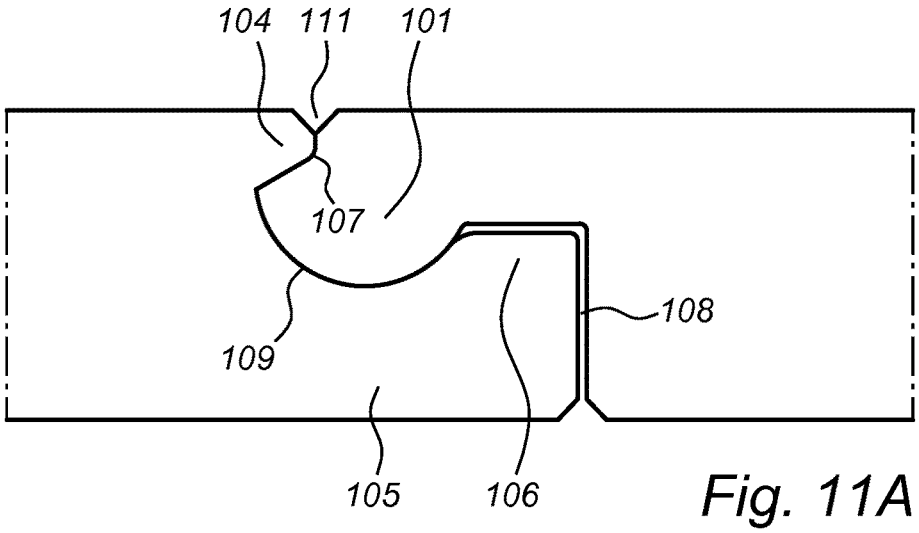
FIGS. 11A-J schematically show various alternative coupling parts.
Figure 11B:
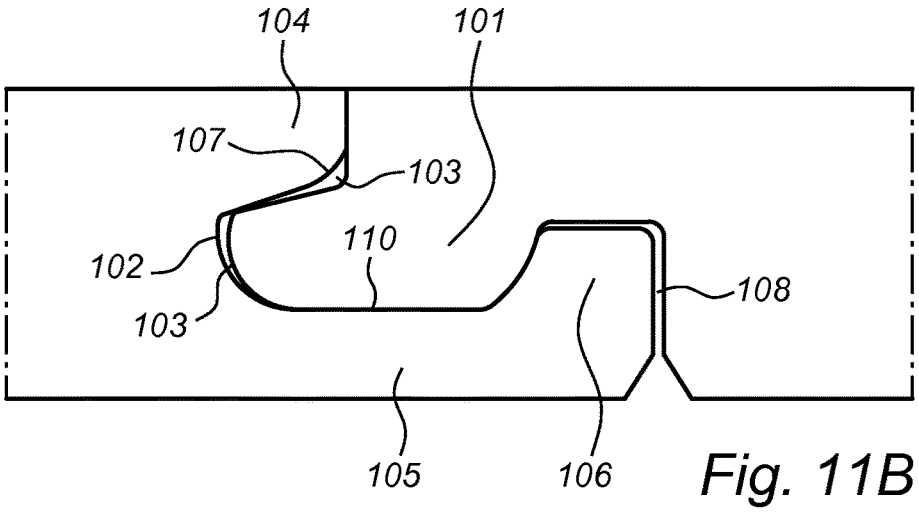
Figure 11C:
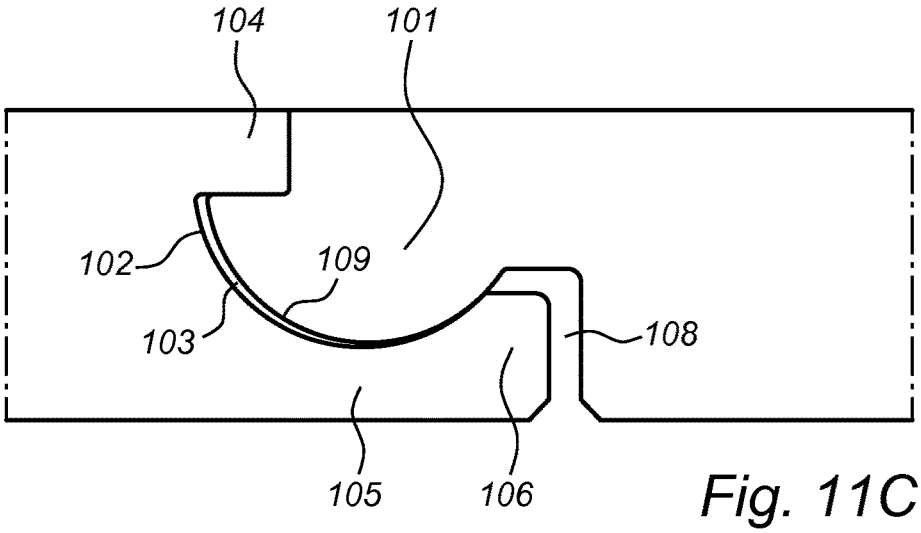
Figure 11D:
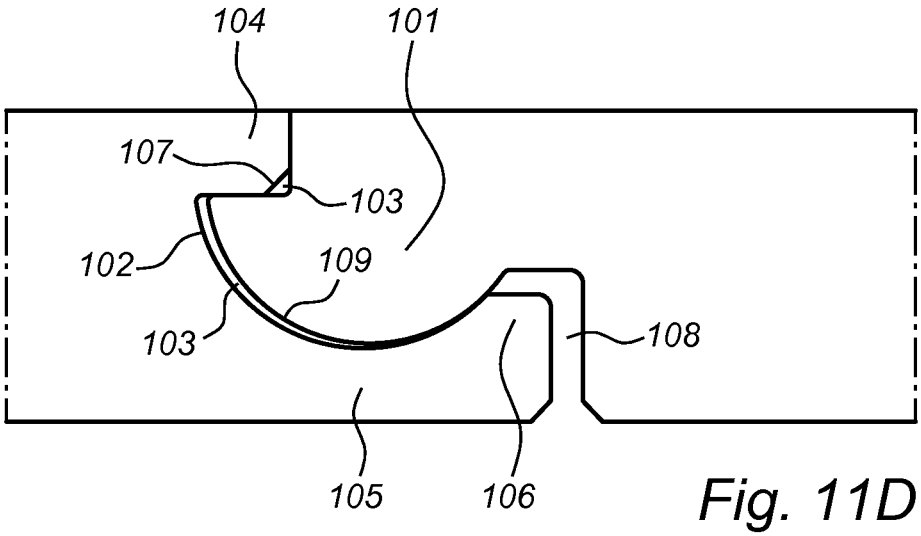
Figure 11E:
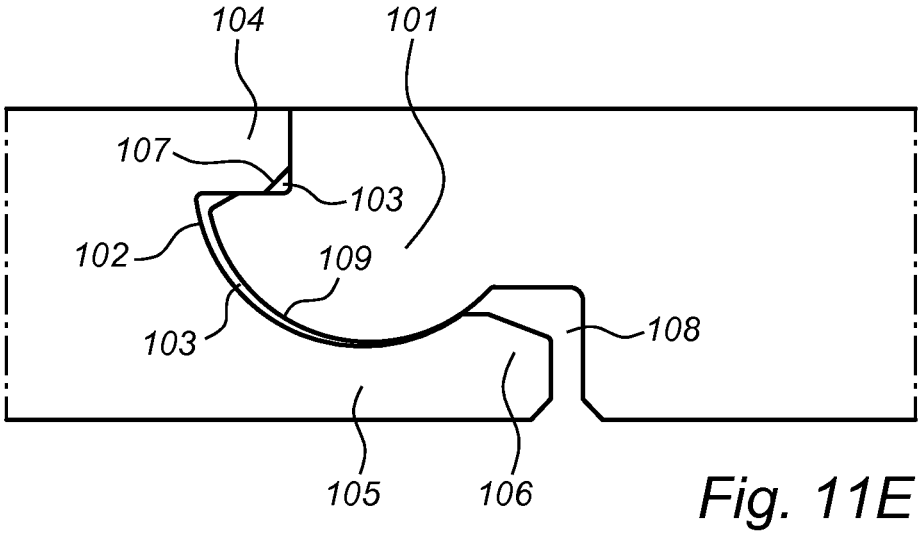
Figure 11F:
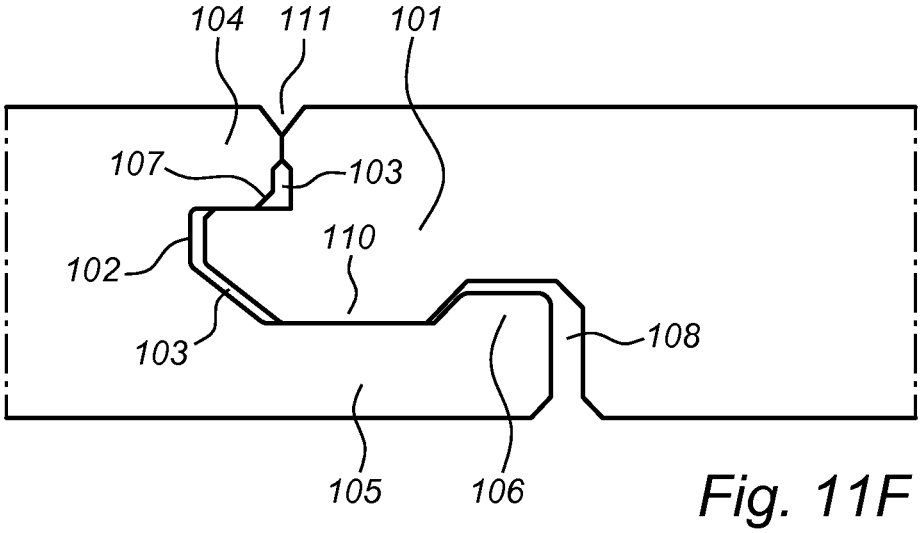
Figure 11G:
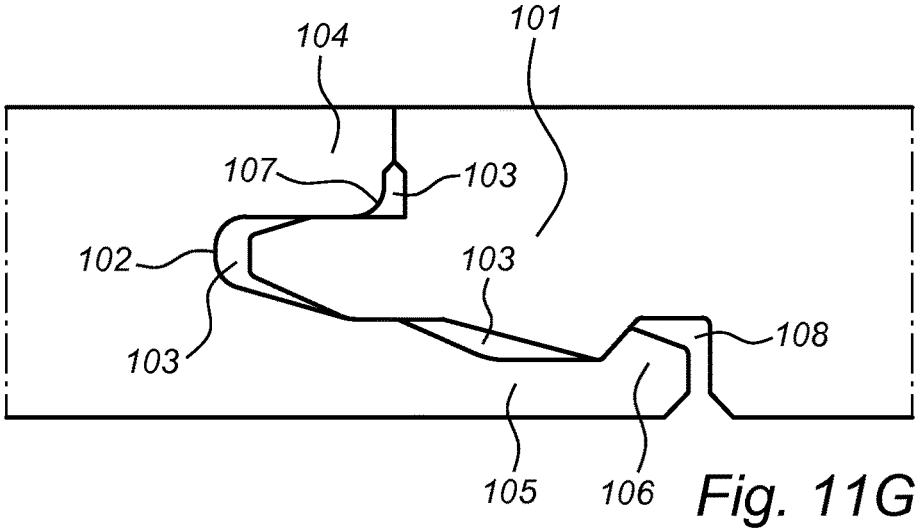
Figure 11H:
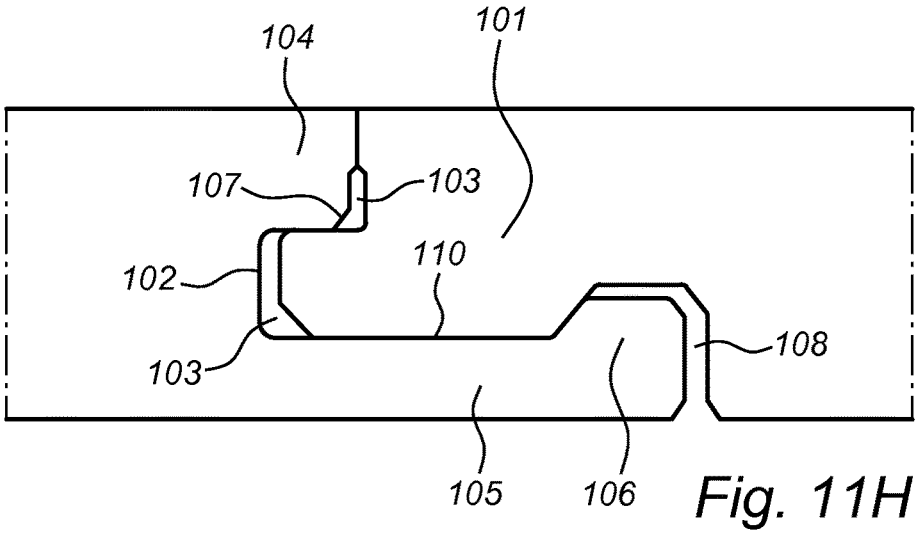
Figure 11I:
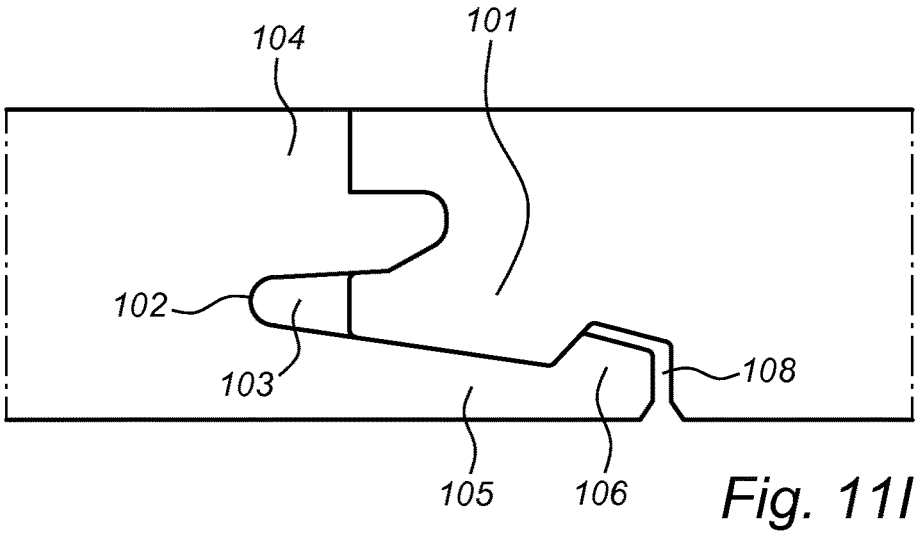
Figure 11J:
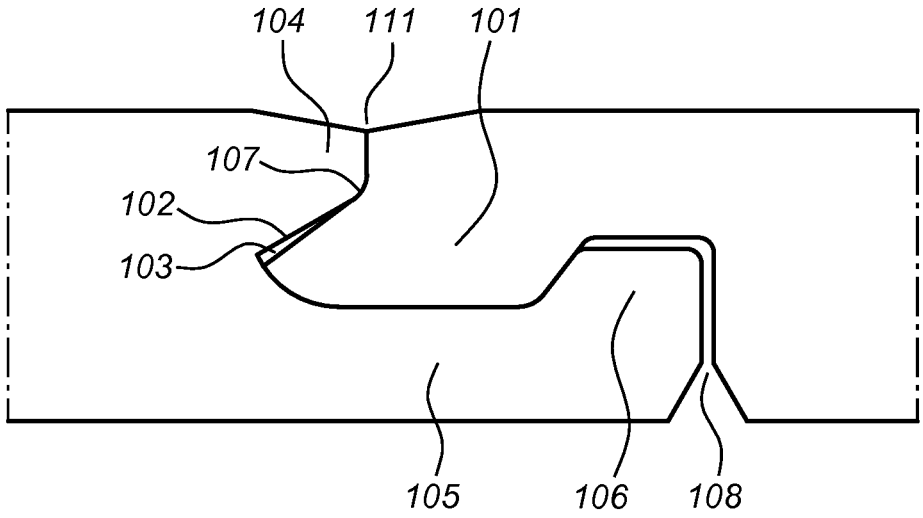

The embodiments as shown in FIGS. 11A, C, D and E have a rounded bottom (109) of the sideward tongue, and a corresponding rounded recess in the sideward groove, which rounding facilitates the angling of such panels. The embodiments of FIGS. 11B, F, H and J rely on a relative flat bottom (110) and corresponding recess, which is easy to produces and increases vertical locking. The embodiments of FIGS. 11A, F and J show the use of a bevel (111) on such angling down profiles. The embodiment of FIG. 11G shows an embodiment of an angling down profile wherein the sideward groove has a specific shape allowing it to force the sideward tongue into the sideward groove in a coupled condition. The embodiment of FIG. 11I shows a double structure, or a sandwich structure of both the sideward tongue and the sideward groove.

Figure 12:
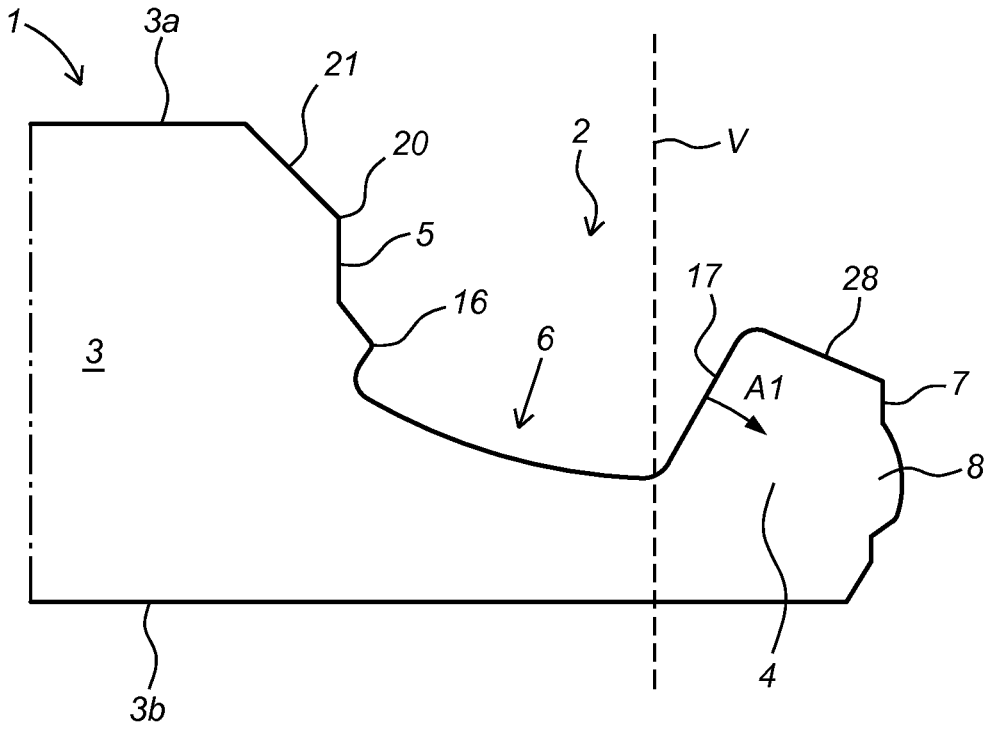
FIG. 12 schematically shows a panel according to the present invention, and shows the first coupling part of the panel.
Figure 13:
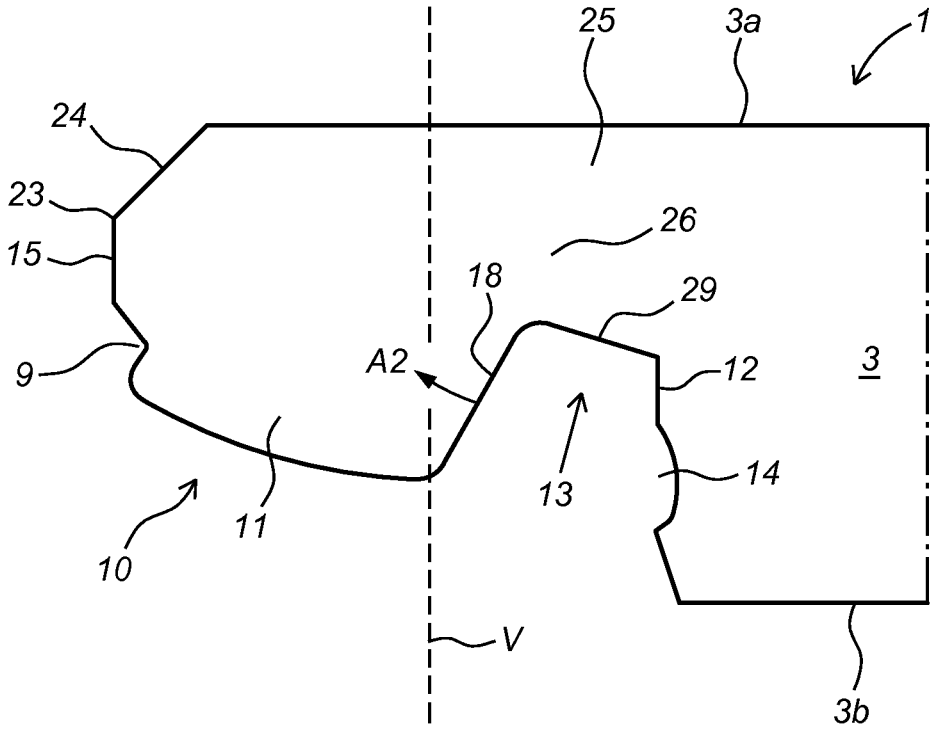
FIG. 13 schematically shows a panel according to the present invention, and shows the second coupling part of the panel.

FIGS. 12 and 13 show a variation on the panels with coupling parts of FIGS. 1 and 2. Corresponding features have been given the same reference numbers. In FIGS. 1 and 2, the third locking element (16) is provided on the outside of the downward tongue (11), in the form of a bulge (16), and the fourth locking element (9) is provided on the upward flank (5), in the form of a recess (9). In FIGS. 12 and 13 a different interpretation is given, in which the upward flank (5) is provided with a third locking element (16) in the form of the bulge (16), and the side of the downward tongue (11) facing away from the downward flank (12) is provided with a fourth locking element (9), in the form of a recess (9).

It will be apparent that the invention is not limited to the working examples shown and described herein, but that numerous variants are possible within the scope of the attached claims that will be obvious to a person skilled in the art.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

The ordinal numbers used in this document, like "first", "second", and "third" are used only for identification purposes. Hence, the use of the expressions "third locking element" and "second locking element" does therefore not necessarily require the co-presence of a "first locking element". The panels according to the invention may also be referred to as tiles. By "complementary" coupling profiles (or locking elements) is meant that these coupling profiles (or locking elements) can cooperate with each other. However, to this end, the complementary coupling profiles (or locking elements) do not necessarily have to have complementary forms. Expressions like "horizontal", "vertical", and "inclined" are relative expressions with respect to a panel being laid on a (virtual) horizontal supporting structure, like a subfloor. Here, a plane defined by the panel is qualified as a horizontal plane. By locking in "vertical direction" is therefore meant locking in a direction perpendicular to the plane of the tile. By locking in "horizontal direction" is therefore meant locking in a direction perpendicular to the respective coupled edges of two tiles and parallel to or falling together with the plane defined by the tiles. In case in this document reference is made to a "floor tile" or "floor panel", these expressions may be replaced by expressions like "tile", "wall tile", "ceiling tile", "covering tile".

The verb "comprise" and conjugations thereof used in this patent publication are understood to mean not only "comprise", but are also understood to mean the phrases "contain", "substantially consist of", "formed by" and conjugations thereof.

The invention claimed is:

1. A panel, comprising:

a centrally located core provided with an upper side and a lower side, wherein the core defines a plane;

at least one first coupling part and at least one second coupling part connected respectively to opposite edges of the core, wherein the at least one first coupling part comprises an upward tongue, at least one upward flank lying at a distance from the upward tongue and an upward groove formed in between the upward tongue and the upward flank wherein the upward groove is adapted to receive at least a part of a downward tongue of a second coupling part of an adjacent panel:

wherein the at least one second coupling part comprises a downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel;

wherein at least a part of a side of the upward tongue facing away from the upward flank is provided with a first locking element in a form of an outward bulge or a recess, adapted for co-action with a second locking element in a form of a recess or an outward bulge, of an adjacent floor panel;

wherein at least a part of a side of the downward flank is provided with a second locking element in a form of a recess or an outward bulge, adapted for co-action with the first locking element in a form of an outward bulge or a recess, of an adjacent floor panel;

wherein at least a part of a side of the downward tongue facing away from the downward flank is provided with a third locking element in a form of an outward bulge or a recess, adapted for co-action with a fourth locking element in a form of a recess or an outward bulge, of an adjacent floor panel;

wherein at least a part of the upward flank is provided with the fourth locking element in a form of a recess or an outward bulge, adapted for co-action with the third locking element in a form of an outward bulge or a recess, of an adjacent floor panel, wherein at least a part of the side of the upward tongue facing toward the upward flank is upwardly inclined towards the upward flank, and wherein at least a part of the side of the downward tongue facing toward the downward flank is downwardly inclined towards the downward flank, and wherein a horizontal centerline of the third locking element, a horizontal centerline of the fourth locking element, or the horizontal centerline of the third locking element and the horizontal centerline of the fourth locking element is situated in between (i) a horizontal centerline (L1) of the first locking element and (ii) a horizontal line (LH) defining a maximum height of the upward tongue.

2. The panel according to claim 1, wherein the horizontal centerline of the third locking element, the horizontal centerline of the fourth locking element, or the horizontal centerline of the third locking element and the horizontal centerline of the fourth locking element is situated in between (i) the horizontal centerline (L1) of the second locking element and (ii) the horizontal line (LH) defining the maximum height of the upward tongue.

3. The panel according to claim 1, wherein at least a part of a side of the downward tongue facing away from the downward flank is provided with a fifth locking element in a form of an outward bulge or a recess, adapted for co-action with a sixth locking element in a form of a recess or an outward bulge of an adjacent floor panel, and wherein at least a part of the upward flank is provided with the sixth locking element in a form of a recess or an outward bulge, adapted for co-action with the fifth locking element in a form of an outward bulge or a recess, of an adjacent floor panel.

4. The panel according to claim 3, wherein one locking element of the third locking element and the fifth locking element is formed by a bulge and one other locking element of the third locking element and fifth locking element is formed by a recess.

5. The panel according to claim 3, wherein one locking element of the fourth locking element and the sixth locking element is formed by a bulge and one other locking element of the fourth locking element and sixth locking element is formed by a recess.

6. The panel according to claim 3, wherein the third locking element and the fifth locking element have different shapes, wherein the fourth locking element and the sixth locking element have different shapes, or wherein the third locking element and the fifth locking element have different shapes and the fourth locking element and the sixth locking element have different shapes.

7. The panel according to claim 3, wherein a centerline of the fifth locking element and a centerline of the sixth locking element are situated above a centerline of the third locking element.

8. The panel according to claim 3, wherein a centerline of the fifth locking element, a centerline of the sixth locking element, or the centerline of the fifth locking element and the centerline of the sixth locking element are situated in between (i) the horizontal centerline (L1) of the first locking element and (ii) the horizontal line (LH) defining the maximum height of the upward tongue.

9. The panel according to claim 1, wherein a transition between the side of the upward tongue facing away from the upward flank, and the upper side of the upward tongue, defines a convex vertex, and wherein a centerline of the fourth locking element substantially coincides with a centerline of said convex vertex.

10. The panel according to claim 9, wherein the convex vertex is defined by a transition between a flat part of the side of the upward tongue facing away from the upward flank, and a flat part of the upper side of the upward tongue.

11. The panel according to claim 1, wherein a transition between the downward flank and the upper side of the downward groove defines a concave vertex, and wherein a centerline of the third locking element is situated in between a centerline of said concave vertex and a centerline of said second locking element.

12. The panel according to claim 11, wherein the transition between the downward flank and the upper side of the downward groove defines the concave vertex, and wherein the centerline of the third locking element substantially coincides with the centerline of said concave vertex.

13. The panel according to claim 1, wherein the upper side of the upward tongue is downwardly inclined in a direction away from the upward flank.

14. The panel according to claim 1, wherein the upper side of the downward groove is downwardly inclined in a direction towards the downward flank.

15. The panel according to claim 1, wherein the substantially complete upper side of the upward tongue is flat.

16. The panel according to claim 1, wherein the side of the upward tongue facing away from the upward flank comprises two substantially vertical side parts, wherein the first locking element is situated in between said substantially vertical side parts.

17. The panel according to claim 1, wherein at least the part of the side of the upward tongue facing toward the upward flank is inclined with respect to a vertical direction and is angled away from the upward flank; and wherein at least a part of a side of the downward tongue facing toward the downward flank is inclined with respect to a vertical direction.

18. The panel according to claim 1, wherein a part of a side of the downward tongue facing away from the downward flank, at least a part of the upward flank, or the part of the side of the downward tongue facing away from the downward flank and at least the part of the upward flank includes at least a portion that is curved or inclined, wherein the third locking element, the fourth locking element, or the third locking element and the fourth locking element is located on the curved or inclined part.

19. The panel according to claim 1, wherein an upper part of the upward flank, an upper part of the side of the downward tongue facing away from the downward flank, or the upper part of the upward flank and the upper part of the side of the downward tongue facing away from the downward flank is provided with a bevel, wherein the third and fourth locking elements are located at a distance from the lowest part of the bevel.

20. The panel according to claim 1, wherein the third locking element is located inward compared to an upper part of the side of the downward tongue facing away from the downward flank.

21. The panel according to claim 1, wherein the third locking element is an outward bulge, and the fourth locking element is a recess, wherein the outward bulge includes at least a portion that is circular in cross section.

22. The panel according to claim 1, wherein between the downward tongue and the core of the panel a bridge part is present, connecting the downward tongue to the core, wherein, the bridge part has a variable thickness between the core and the downward tongue.

23. The panel according to claim 1, wherein the third and fourth locking elements are arranged at a higher level compared to a level of the first and second locking elements.

24. The panel according to claim 1, wherein the third and fourth locking elements are arranged at a lower level compared to a highest point of the upward tongue.

25. The panel according to claim 1, wherein the third and fourth locking elements are arranged, at least in vertical direction, between a highest point of the upward tongue and a level of the first and second locking elements.

26. The panel according to claim 1, wherein the third and fourth locking elements are adapted for co-action to provide a vertical locking, wherein the first and second locking elements are adapted for co-action to provide a vertical locking, or wherein the third and fourth locking elements are adapted for co-action to provide a vertical locking and the first and second locking elements are adapted for co-action to provide a vertical locking.

27. The panel according to claim 1, wherein the second coupling part is configured to deform at least temporary during coupling.

28. The panel according to claim 1, wherein, in a coupled condition, a gap is present between the upper side of the upward tongue and the upper side of the downward groove, wherein the gap widens from the side of the upward tongue facing towards the upward flank to the downward flank.

29. The panel according to claim 1, wherein a minimal thickness of the second coupling part is less than half a total thickness of the panel.

30. The panel according to claim 1, wherein beneath the first coupling element, in particular beneath the upward tongue thereof, a space is present, such that, when placed on a floor, a gap exists between the upward tongue and the floor the panel is placed on.

31. A covering comprising a plurality of interconnected panels according to claim 1.

* * * * *